US009796562B2

(12) United States Patent
Yao

(10) Patent No.: US 9,796,562 B2
(45) Date of Patent: Oct. 24, 2017

(54) ELEVATOR CONTROLLING PANEL AND ELEVATOR APPARATUS THAT USES THE SAME

(71) Applicant: Tomohiko Yao, Chiyoda-ku (JP)

(72) Inventor: Tomohiko Yao, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 296 days.

(21) Appl. No.: 14/427,451

(22) PCT Filed: Oct. 3, 2012

(86) PCT No.: PCT/JP2012/075663
§ 371 (c)(1),
(2) Date: Mar. 11, 2015

(87) PCT Pub. No.: WO2014/054134
PCT Pub. Date: Apr. 10, 2014

(65) Prior Publication Data
US 2015/0210508 A1 Jul. 30, 2015

(51) Int. Cl.
*B66B 11/00* (2006.01)
*B66B 1/34* (2006.01)
(Continued)

(52) U.S. Cl.
CPC ..... *B66B 11/002* (2013.01); *B66B 1/3423* (2013.01); *B66B 5/0081* (2013.01); *B66B 9/00* (2013.01)

(58) Field of Classification Search
CPC ... B66B 11/002; B66B 1/3423; B66B 5/0081; B66B 9/00
See application file for complete search history.

(56) References Cited

U.S. PATENT DOCUMENTS 4,875,552 A * 10/1989 Smith ..... B66B 11/0226 160/135
5,592,780 A * 1/1997 Checkovich ..... E05F 3/222 16/49
(Continued)

FOREIGN PATENT DOCUMENTS

JP 2000-159452 A 6/2000
JP 2002 338152 11/2002
(Continued)

OTHER PUBLICATIONS

Office Action dated Sep. 8, 2015 in Japanese Patent Application No. 2014-539525 (with partial English language translation).
(Continued)

*Primary Examiner* — Michael Riegelman
(74) *Attorney, Agent, or Firm* — Oblon, McClelland, Maier & Neustadt, L.L.P.

(57) ABSTRACT

In an elevator controlling panel, an opening portion of a front surface of a case is opened and closed by a front cover. A bent portion is disposed on a first end portion in a width direction of the front cover. A slit is disposed on the bent portion. A shaft member that guides opening and closing operations of the front cover by being moved relatively along the slit, and that also stops the front cover from dislodging from the case, is disposed on a side surface of the case. The slit has a shape such that the opening portion is opened by sliding the front cover forward relative to the controlling panel main body and then upward.

11 Claims, 28 Drawing Sheets

(51) Int. Cl.
*B66B 5/00* (2006.01)
*B66B 9/00* (2006.01)

(56) References Cited

U.S. PATENT DOCUMENTS 5,829,554 A * 11/1998 Benson ..... B66B 1/466 187/395
6,230,845 B1 * 5/2001 Yamakawa ..... B66B 11/001 187/314
6,378,660 B1 * 4/2002 Adifon ..... B66B 9/04 187/272
6,405,834 B1 * 6/2002 Chida ..... B66B 1/46 187/263
6,484,850 B1 * 11/2002 Kobayashi ..... B66B 13/303 187/414
7,398,861 B2 * 7/2008 Rossignol ..... B66B 13/30 187/276
8,746,412 B2 * 6/2014 Rebillard ..... B66B 13/306 187/314
9,573,791 B2 * 2/2017 Garcia ..... B66B 11/0005
2009/0266648 A1 * 10/2009 Asensio Bazterra ... B66B 9/022 187/270
2011/0240407 A1 * 10/2011 Ericson ..... B66B 11/002 187/250
2012/0304550 A1 * 12/2012 Teixeira Pinto Dias ..... B66B 13/306 52/30
2012/0305337 A1 * 12/2012 Hopp ..... B66B 13/306 187/336
2014/0216854 A1 * 8/2014 Stofira ..... B66B 11/002 187/247

FOREIGN PATENT DOCUMENTS

JP 2007 106512 4/2007
JP 2007 311594 11/2007
JP 2008 150161 7/2008

OTHER PUBLICATIONS

International Search Report dated Jan. 29, 2013 in PCT/JP12/075663 Filed Oct. 3, 2012.

* cited by examiner

ELEVATOR CONTROLLING PANEL AND ELEVATOR APPARATUS THAT USES THE SAME

TECHNICAL FIELD

The present invention relates to an elevator controlling panel in which an opening portion of a case of a controlling panel main body is opened and closed by a front cover, and to an elevator apparatus that uses the same.

BACKGROUND ART

In conventional elevator controlling panels, a front surface cover is divided into three parts vertically. These covers are a type of cowling, and the covers are removed from a main body panel completely when opening a front surface of the main body panel (see Patent Literature 1, for example).

In other conventional elevator controlling panels, a first end portion in a width direction of a cover is connected to a box body by means of a plurality of hinges (a type of door). Because of that, when a front surface of the box body is opened, the cover is pivoted around the hinges and opened out (see Patent Literature 2, for example).

CITATION LIST

Patent Literature

[Patent Literature 1]
Japanese Patent Laid-Open No. 2002-338152 (Gazette, FIG. 1)
[Patent Literature 2]
Japanese Patent Laid-Open No. 2008-150161 (Gazette, FIG. 3)

SUMMARY OF THE INVENTION

Problem to be Solved by the Invention

Generally, in machine-roomless elevators, the controlling panel is installed inside a hoistway. Because of that, depending on the position (the height) of installation of the controlling panel, a need may arise to perform maintenance work on the controlling panel from a top of a car. In regard to that, in controlling panels that have a conventional cowling-type cover, because the cover is disconnected from the main body, it has been necessary to adopt precautionary measures against dropping.

Because a safety fence is disposed for workers on top of the car, in controlling panels that have a conventional door-type cover, the cover may interfere with the car or the safety fence, making it difficult to open out the cover.

The present invention aims to solve the above problems and an object of the present invention is to provide an elevator controlling panel that enables an opening portion to be opened while a front cover remains connected to a controlling panel main body while avoiding interference between the front cover and a car and between the front cover and a safety fence, and an elevator apparatus that uses the same.

Means for Solving the Problem

In order to achieve the above object, according to one aspect of the present invention, there is provided an elevator controlling panel including: a controlling panel main body that has a case on a front surface of which an opening portion is disposed; and a front cover that opens and closes the opening portion, wherein: a bent portion is disposed on a first end portion in a width direction of the front cover; a slit is disposed on the bent portion; a shaft member that guides opening and closing operations of the front cover by being moved relatively along the slit, and that also stops the front cover from dislodging from the case, is disposed on a side surface of the case; and the slit has a shape such that the opening portion is opened by sliding the front cover forward relative to the controlling panel main body and then upward.

According to another aspect of the present invention, there is provided an elevator apparatus including: a car that is raised and lowered inside a hoistway; and an elevator controlling panel that is disposed inside the hoistway, and on which maintenance work is performed from on top of the car, the elevator controlling panel including: a controlling panel main body that has a case on a front surface of which an opening portion is disposed; and a front cover that opens and closes the opening portion, wherein: a bent portion is disposed on a first end portion in a width direction of the front cover; a slit is disposed on the bent portion; a shaft member that guides opening and closing operations of the front cover by being moved relatively along the slit, and that also stops the front cover from dislodging from the case, is disposed on a side surface of the case; and the slit has a shape such that the opening portion is opened by sliding the front cover forward relative to the controlling panel main body and then upward.

Effects of the Invention

In an elevator controlling panel and an elevator apparatus according to the present invention, because the shaft member that guides opening and closing operations of the front cover, and that also stops the front cover from dislodging from the case, is disposed on a side surface of the case, and the slit has a shape such that the opening portion is opened by sliding the front cover forward relative to the controlling panel main body and then upward, an opening portion can be opened while a front cover remains connected to the controlling panel main body while avoiding interference between the front cover and the car and between the front cover and the safety fence.

DESCRIPTION OF EMBODIMENTS

Preferred embodiments of the present invention will now be explained with reference to the drawings.

Embodiment 1

Figure 1:
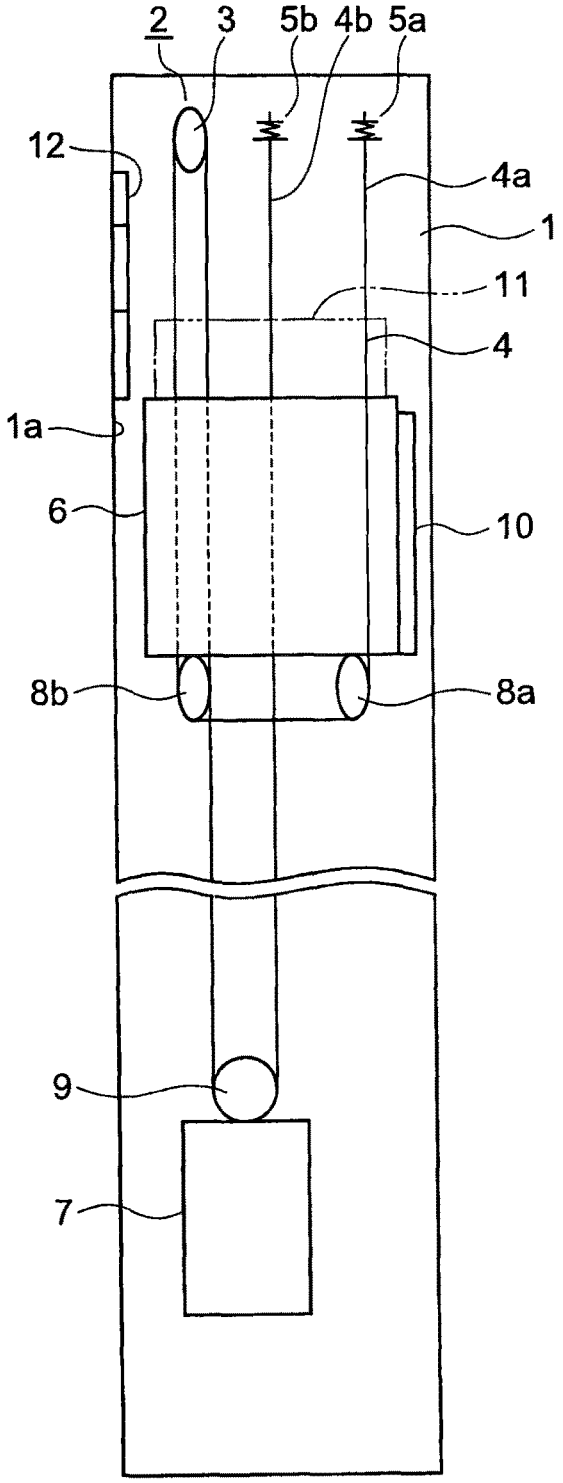
FIG. 1 is a schematic configuration diagram that shows a machine-roomless elevator according to Embodiment 1 of the present invention.

FIG. 1 is a schematic configuration diagram that shows a machine-roomless elevator (and elevator apparatus) according to Embodiment 1 of the present invention. In the figure, a hoisting machine 2 is disposed in an upper portion (a top portion) inside a hoistway 1. The hoisting machine 2 has: a driving sheave 3; a hoisting machine motor (not shown) that rotates the hoisting machine driving sheave 3; and a hoisting machine brake 3*b* (not shown) that brakes rotation of the driving sheave 3.

A suspending body 4 is wound onto the driving sheave 3. A plurality of ropes or a plurality of belts are used as the suspending body 4. The suspending body 4 has: a first end portion (a car-side end portion) 4*a*; and a second end portion (a counterweight-side end portion) 4*b*. The first end portion 4*a* is connected to a first rope fastening portion 5*a* that is disposed in an upper portion inside the hoistway 1. The second end portion 4*b* is connected to a second rope fastening portion 5*b* that is disposed in the upper portion inside the hoistway 1.

A car 6 and a counterweight 7 are suspended inside the hoistway 1 by the suspending body 4, and are raised and lowered inside the hoistway 1 by the hoisting machine 2. A pair of car guide rails (not shown) that guide raising and lowering of the car 6 and a pair of counterweight guide rails (not shown) that guide raising and lowering of the counterweight 7 are installed inside the hoistway 1.

First and second car suspending sheaves 8*a* and 8*b* are disposed on a lower portion of the car 6. A counterweight suspending sheave 9 is disposed on an upper portion of the counterweight 7. The suspending body 4 is wound sequentially from the first end portion end 4*a* around the first car suspending sheave 8*a*, the second car suspending sheave 8*b*, the driving sheave 3, and the counterweight suspending sheave 9. In other words, the car 6 and the counterweight 7 are suspended using a two-to-one (2:1) roping method.

A car door apparatus 10 that opens and closes a car doorway is disposed on a front surface of the car 6. A safety fence 11 that is disposed so as to stand during maintenance work on top of the car 6 is disposed on top of the car 6.

An elevator controlling panel 12 that controls operation of the car 6 is installed in an upper portion inside the hoistway 1. The elevator controlling panel 12 is disposed so as not to interfere with the car 6 in a space between the car 6 and the hoistway wall 1*a* when viewed from directly above.

For this purpose, a thin vertically-oriented controlling panel in which a vertical dimension is greater than a dimension in a width direction (a direction that is perpendicular to the surface of the page in FIG. 1), and in which a thickness dimension (a dimension in a lateral direction in FIG. 1) is less than the dimension in the width direction, is used as the elevator controlling panel 12. Maintenance work on the elevator controlling panel 12 is also performed from on top of the car 6.

Figure 2:
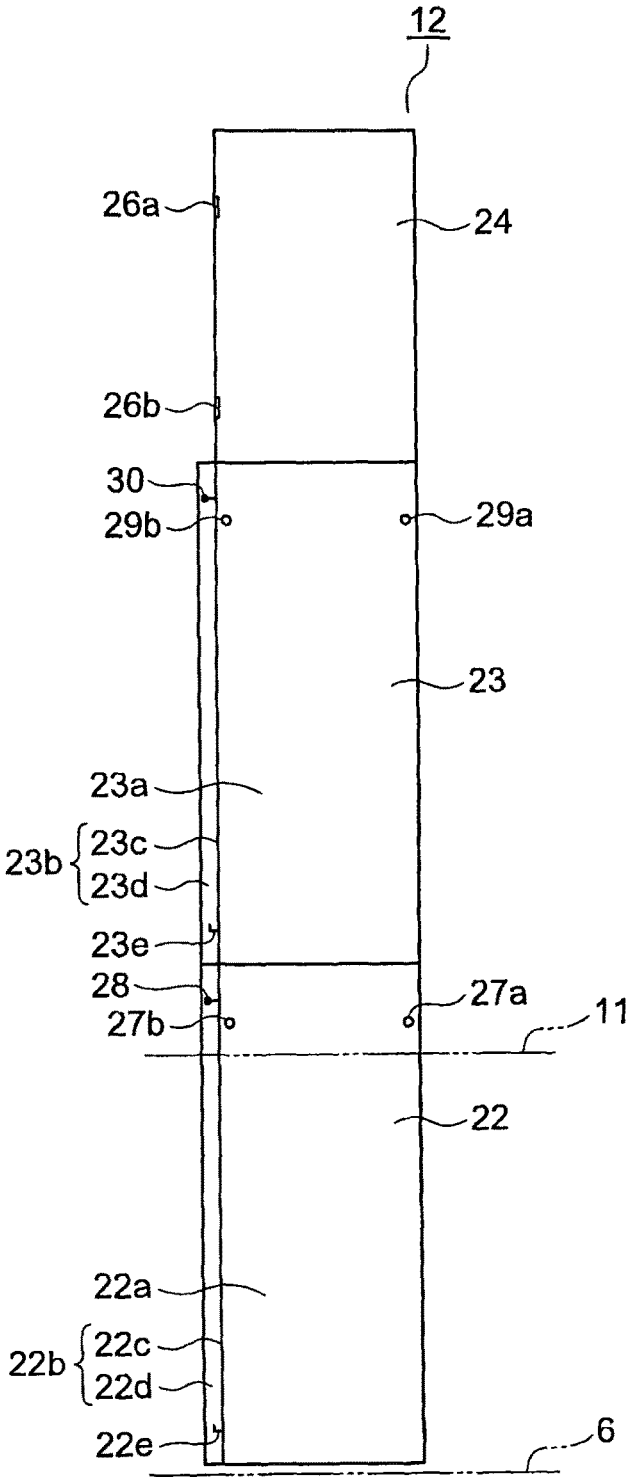
FIG. 2 is a front elevation that shows an elevator controlling panel from FIG. 1.
Figure 3:
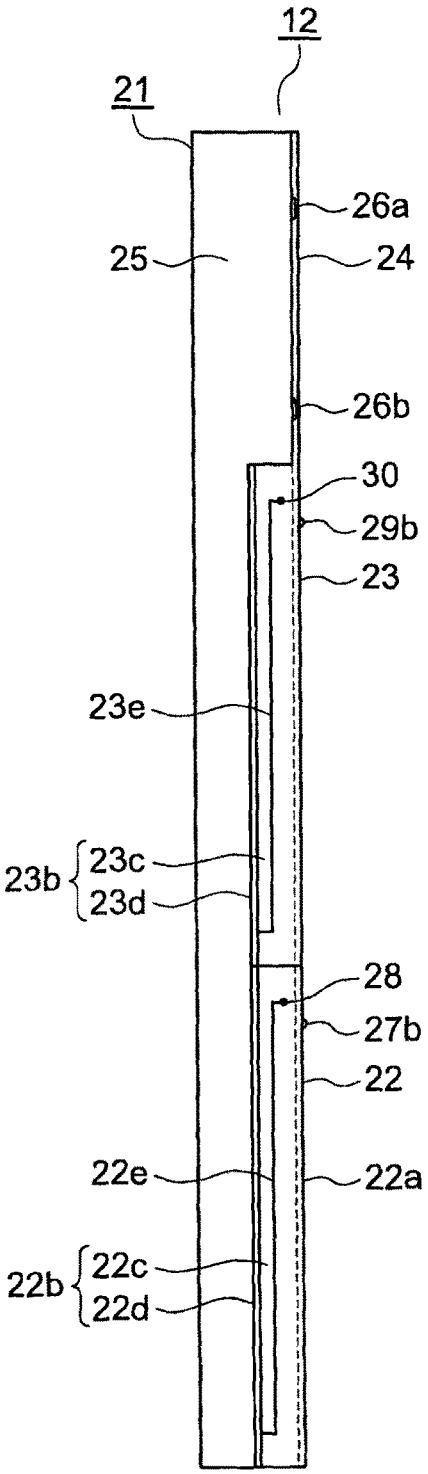
FIG. 3 is a left side elevation that shows the elevator controlling panel from FIG. 2.

FIG. 2 is a front elevation that shows the elevator controlling panel 12 from FIG. 1, and FIG. 3 is a left side elevation that shows the elevator controlling panel 12 from FIG. 2. The elevator controlling panel 12 has: a controlling panel main body 21; and first through third partial covers 22 through 24 that constitute a front cover. The controlling panel main body 21 has: a case 25 on a front surface of which an opening portion is disposed; and a plurality of items of controlling equipment (not shown) that are accommodated inside the case 25. The opening portion of the case 25 is opened and closed by the first through third partial covers 22 through 24.

The first partial cover 22 is disposed on a lower section of the case 25. The second partial cover 23 is disposed on a middle section of the case 25 adjacently above the first partial cover 22. The third partial cover 24 is disposed on an upper section of the case 25 adjacently above the second partial cover 23. The first through third partial covers 22 through 24 are able to be opened and closed independently from each other.

The third partial cover 24 is connected to the case 25 by means of a plurality of (in this example, two) hinges 26*a* and 26*b*. In other words, the third partial cover 24 is a normal door-type cover.

The first partial cover 22 has: a flat cover main body 22*a* that covers the opening portion of the case 25; and a bent (joggle-bent) portion 22*b* that has a Z-shaped cross section that is formed on a first end portion in a width direction of the cover main body 22*a*. The bent portion 22*b* has: a cover side surface portion 22*c* that protrudes perpendicularly rearward from the first end portion in the width direction of the cover main body 22*a*; and a protruding portion 22*d* that protrudes perpendicularly outward from an end portion at an opposite end of the cover side surface portion 22*c* from the cover main body 22*a*.

The first partial cover 22 is fixed to the case 25 using a plurality of (in this example, two) cover fixing screws 27*a* and 27*b* that function as cover fastening devices.

A first shaft member 28 that passes through the bent portion 22*b* is disposed so as to stand on a side surface of the case 25. A slit 22*e* is disposed on the bent portion 22*b*. The first shaft member 28 is passed through the slit 22*e* and guides opening and closing operations of the first partial cover 22 by being moved relatively along the slit 22*e*.

The configuration of the second partial cover 23 is similar or identical to that of the first partial cover 22. Specifically, the second partial cover 23 has: a flat cover main body 23*a* that covers the opening portion of the case 25; and a bent (joggle-bent) portion 23*b* that has a Z-shaped cross section that is formed on a first end portion in a width direction of the cover main body 23*a*. The bent portion 23*b* has: a cover side surface portion 23*c* that protrudes perpendicularly rearward from the first end portion in the width direction of the cover main body 23*a*; and a protruding portion 23*d* that protrudes perpendicularly outward from an end portion at an opposite end of the cover side surface portion 23*c* from the cover main body 23*a*.

The second partial cover 23 is fixed to the case 25 using a plurality of (in this example, two) cover fixing screws 29*a* and 29*b* that function as cover fastening devices.

A second shaft member 30 that passes through the bent portion 23*b* is disposed so as to stand on a side surface of the case 25. A slit 23*e* is disposed on the bent portion 23*b*. The second shaft member 30 is passed through the slit 23*e* and guides opening and closing operations of the first partial cover 23 by being moved relatively along the slit 23*e*.

Figure 4:
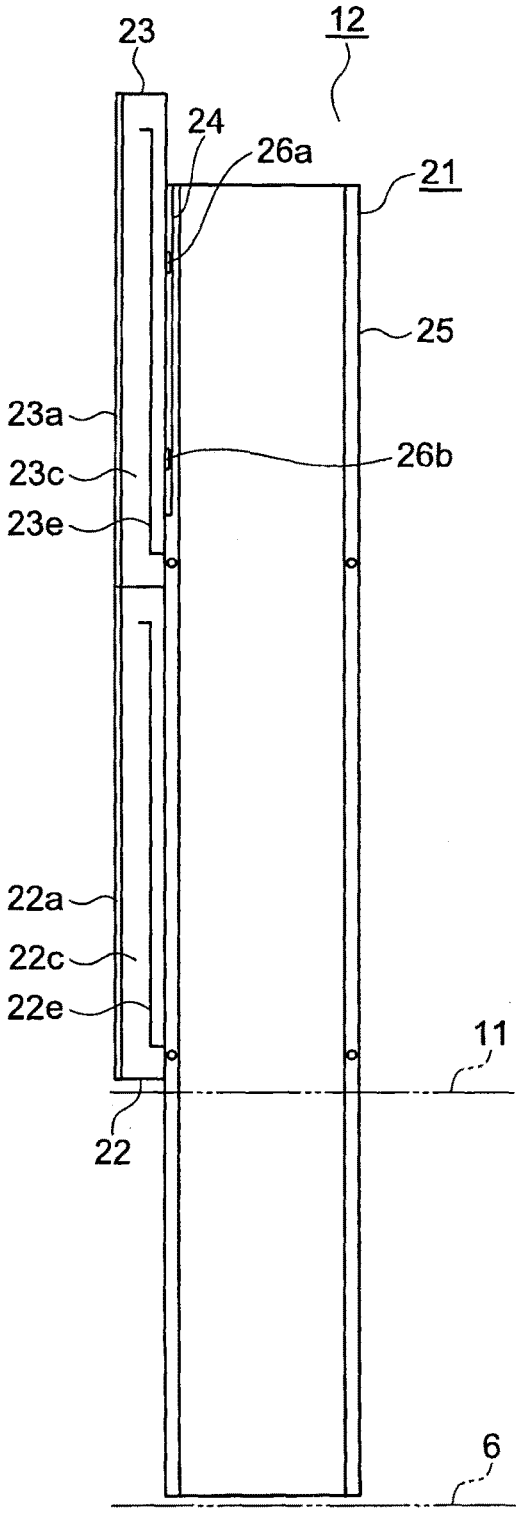
FIG. 4 is a front elevation that shows a state in which first through third partial covers from FIG. 2 are opened out to a fully open position.
Figure 5:
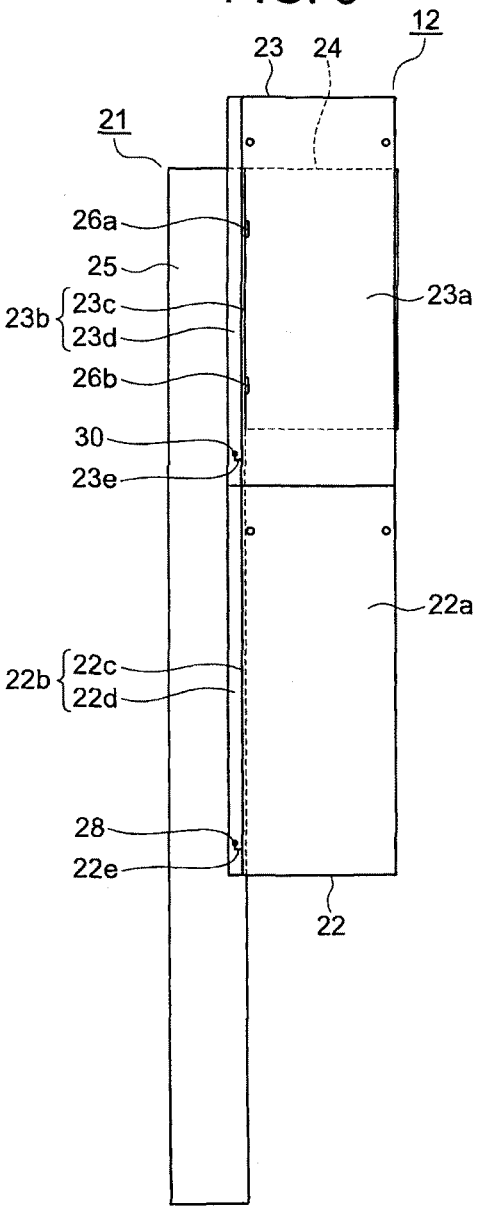
FIG. 5 is a left side elevation that shows the elevator controlling panel from FIG. 4.

FIG. 4 is a front elevation that shows a state in which the first through third partial covers 22 through 24 from FIG. 2 are opened out to a fully open position, and FIG. 5 is a left side elevation that shows the elevator controlling panel 12 from FIG. 4. In Embodiment 1, the opening operation of the first partial cover 22 is enabled by removing the cover fixing screws 27*a* and 27*b*, and the opening operation of the second partial cover 23 is enabled by removing the cover fixing screws 29*a* and 29*b*.

The slits 22*e* and 23*e* have shapes such that that the opening portion of the case 25 is opened by sliding the partial covers 22 and 23 forward on the controlling panel main body 21 and then sliding them upward. The slits 22*e* and 23*e* also have shapes that enable opening out by sliding the partial covers 22 and 23 upward and then rotating the partial covers 22 and 23 around the shaft members 28 and 30.

Figure 6:
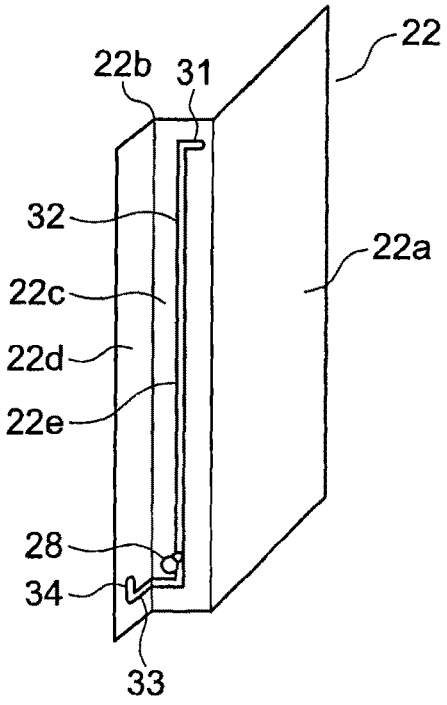
FIG. 6 is an oblique projection that shows an intermediate state during the opening operation of the first partial cover from FIG. 2.

FIG. 6 is an oblique projection that shows an intermediate state during the opening operation of the first partial cover 22 from FIG. 2. The slit 22*e* has: an upper portion horizontal portion 31; a vertical portion 32; a lower portion horizontal portion 33; and an opening holding portion 34. The upper portion horizontal portion 31 is disposed horizontally in a vicinity of the cover side surface portion 22*c*. The lower portion horizontal portion 33 is disposed horizontally so as to span the cover side surface portion 22*c* and the protruding portion 22*d* in a vicinity of a lower end portion of the bent portion 22*b*.

The vertical portion 32 is disposed vertically between an end portion at an opposite end of the upper portion horizontal portion 31 from the cover main body 22*a* and an end portion of the lower portion horizontal portion 33 near the cover main body 22*a*. The opening holding portion 34 is disposed vertically upward from an end portion at an opposite end of the lower portion horizontal portion 33 from the vertical portion 32.

When the first partial cover 22 is in a fully closed position, the first shaft member 28 is positioned at an end portion of the upper portion horizontal portion 31 near the cover main body 22*a*. When the first partial cover 22 is made to perform the opening operation, the first shaft member 28 is moved relative to the slit 22*e* sequentially through the upper portion horizontal portion 31, the vertical portion 32, and the lower portion horizontal portion 33. Then, when the first partial cover 22 is in a fully open position, the first shaft member 28 is positioned at an upper end portion of the opening holding portion 34.

Figure 7:
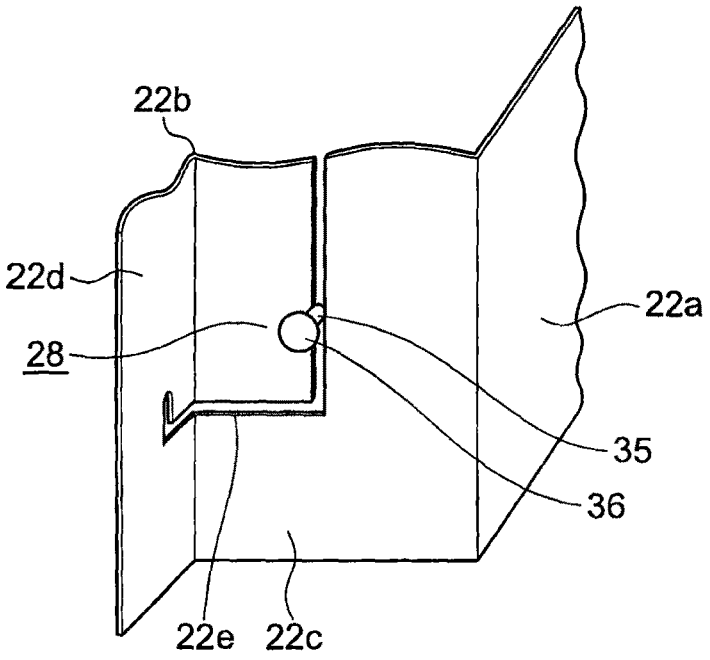
FIG. 7 is an oblique projection that shows part of FIG. 6 enlarged.

FIG. 7 is an oblique projection that shows part of FIG. 6 enlarged. The first shaft member 28 has: a shaft portion 35 that is passed through the slit 22*e*; and a spherical head portion 36 that is disposed on an end portion of the shaft portion 35, and that stops the first shaft member 28 from dislodging from the slit 22*e*.

A clearance (gap or margin) is disposed between the head portion 36 and the first partial cover 22. The first partial cover 22 is thereby slidable in a width direction of the case 25 by an amount equal to the clearance.

A shape of the slit 23*e* of the second partial cover 23, positional relationships between the slit 23*e* and the second shaft member 30, and a configuration of the second shaft member 30, etc., are similar or identical to those of the slit 22*e* and the first shaft member 28.

Next, operation will be explained. When maintenance work is performed on the elevator controlling panel 12, maintenance personnel board the top of the car 6, and move the car 6 such that a floor surface on top of the car 6 is positioned slightly below a lower end portion of the elevator controlling panel 12 as indicated by the double-dotted chain lines in FIG. 2. Then, the cover fixing screws 27*a* and 27*b* are removed.

Next, using a gap between the safety fence 11 and the first partial cover 22, the first partial cover 22 is pulled forward (toward the safety fence 11). Next, the first partial cover 22 is slid to the left in a width direction of the case 25. Interference with the second partial cover 23 is thereby avoided, enabling the first partial cover 22 to be slid upward.

In this state, the first partial cover 22 is slid straight upward until the first shaft member 28 moves to the lower end portion of the vertical portion 32. A lower end portion of the first partial cover 22 is thereby moved above an upper end portion of the safety fence 11. In other words, the first partial cover 22 is slidable until higher than an upper end of the safety fence 11 when the floor surface on top of the car 6 is made level with a lower end of the first partial cover 22.

Next, the first partial cover 22 is opened out by approximately 90 degrees around the first shaft member 28. The first partial cover 22 is then moved slightly downward such that the first shaft member 28 moves to an upper end of the opening holding portion 34. Here, the first partial cover 22 may alternatively be rested on the safety fence 11 such that the first partial cover 22 is supported by the safety fence 11. Moreover, when restoring the first partial cover 22 to the fully closed position, the above-mentioned procedure is reversed.

The opening operation and the closing operation of the second partial cover 23 are similar or identical to those of the first partial cover 22. If a height dimension of the elevator controlling panel 12 is large, then the maintenance work on the elevator controlling panel 12 should be performed while moving the car 6 vertically, if required.

Thus, according to the elevator controlling panel 12 according to Embodiment 1, the opening portion of the case 25 can be opened while the first and second partial covers 22 and 23 remain connected to the controlling panel main body 21 while avoiding interference between the first and second partial covers 22 and 23 and the car 6 and the safety fence 11, as shown in FIG. 4. Because of that, it is not necessary to adopt precautionary measures against dropping of the first and second partial covers 22 and 23.

Because opening out is enabled by sliding the first and second partial covers 22 and 23 upward and then rotating the first and second partial covers 22 and 23 around the shaft members 28 and 30, the first and second partial covers 22 and 23 can be moved simultaneously to the fully open position.

In addition, because a clearance is disposed between the head portions 36 of the first and second shaft members 28 and 30 and the first and second partial covers 22 and 23, and the first and second partial covers 22 and 23 are slidable in the width direction of the case 25 by an amount equal to the clearance, the first and second partial covers 22 and 23 can be moved upward while easily avoiding interference with the cover that is adjacently above.

Furthermore, the height dimension of the first partial cover 22 is formed so as to be greater than the height dimension of the safety fence 11, and the first partial cover 22 is slidable until higher than the upper end of the safety fence 11 when the floor surface on top of the car 6 is made level with the lower end of the first partial cover 22. Consequently, interference with the safety fence 11 can be avoided more reliably.

Moreover, in Embodiment 1, a configuration is shown in which all of the partial covers 22 through 24 open out to the left side, but all or some of the partial covers 22 through 24 may alternatively be made so as to open out to the right side.

In Embodiment 1, a front cover that is in three parts is used, but the front cover may alternatively be in a single part, two parts, or four or more parts. If a front cover that is in two or more parts is used, then the present invention may be alternatively applied to any number of those parts of the front cover.

In addition, if a front cover that is in two or more parts is used, the height dimensions of each of the parts of the front cover do not need to be equal, and can be set freely.

Embodiment 2

Figure 8:
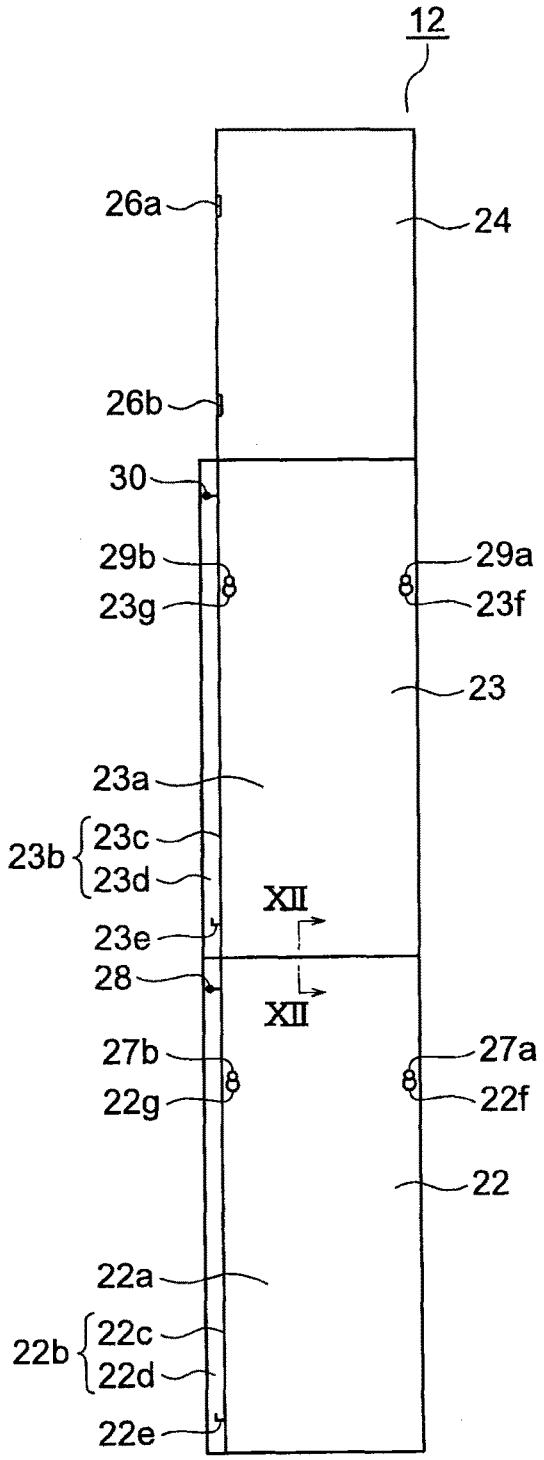
FIG. 8 is a front elevation that shows an elevator controlling panel according to Embodiment 2 of the present invention.
Figure 9:
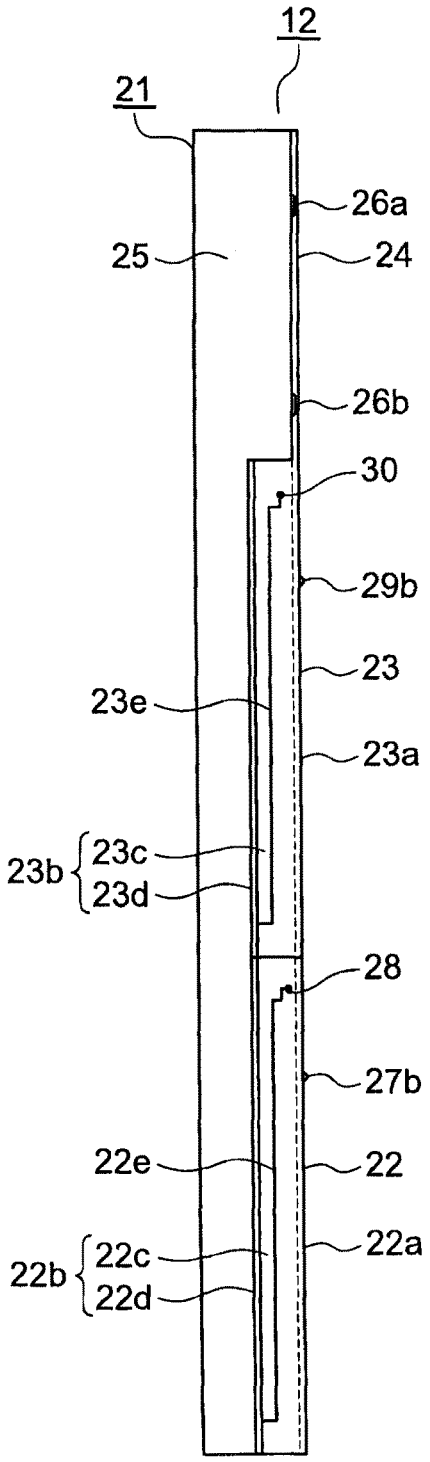
FIG. 9 is a left side elevation that shows the elevator controlling panel from FIG. 8.
Figure 10:
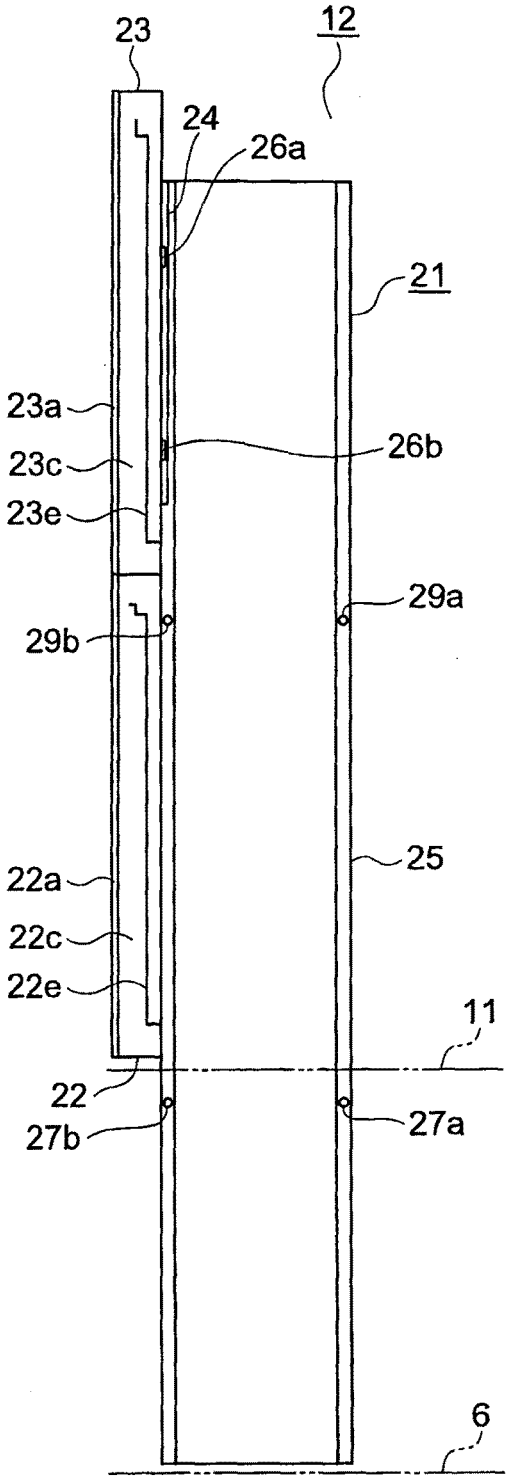
FIG. 10 is a front elevation that shows the state in which first through third partial covers from FIG. 8 are opened out to a fully open position.
Figure 11:
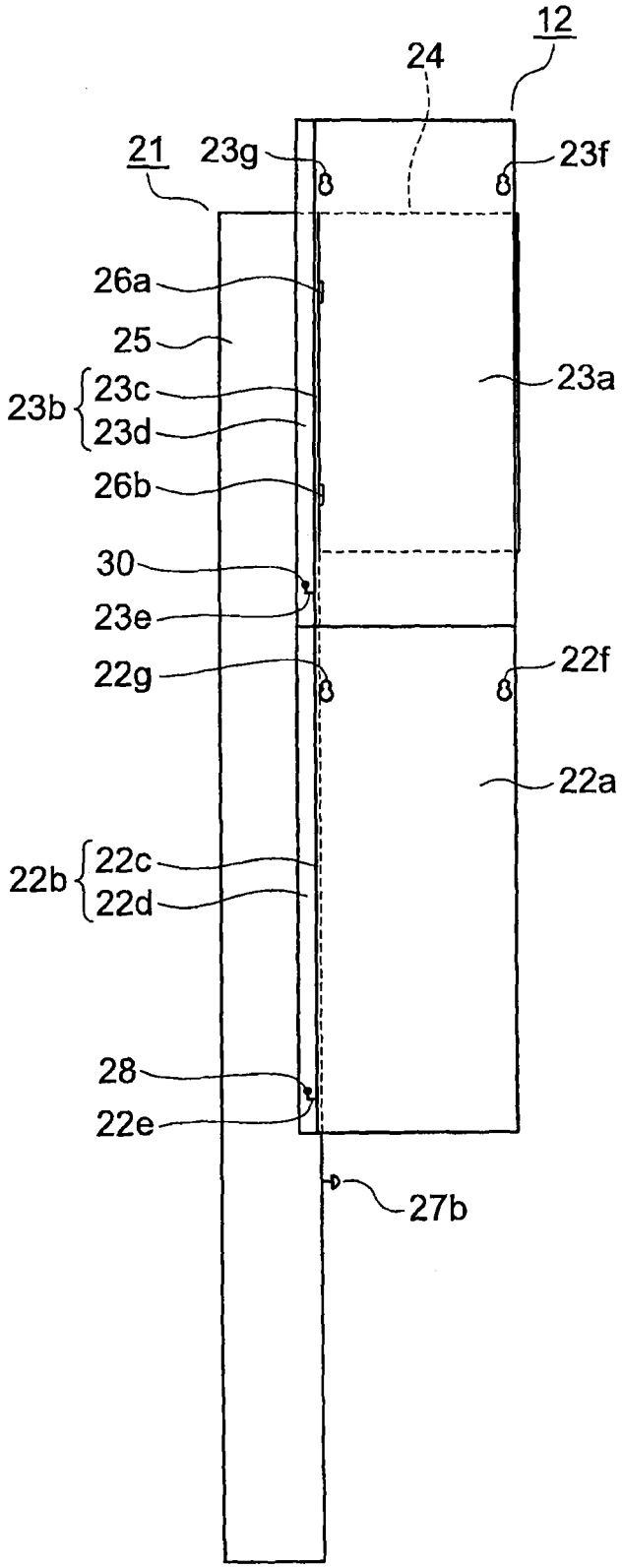
FIG. 11 is a left side elevation that shows the elevator controlling panel from FIG. 10.

Next, FIG. 8 is a front elevation that shows an elevator controlling panel 12 according to Embodiment 2 of the present invention, FIG. 9 is a left side elevation that shows the elevator controlling panel 12 from FIG. 8, FIG. 10 is a front elevation that shows the state in which first through third partial covers 22 through 24 from FIG. 8 are opened out to a fully open position, and FIG. 11 is a left side elevation that shows the elevator controlling panel 12 from FIG. 10.

In the figures, a plurality of (in this example, two) keyhole slots (snowman-shaped slots) 22*f* and 22*g* that allow passage of cover fixing screws 27*a* and 27*b* are disposed on a cover main body 22*a* of a first partial cover 22. A plurality of (in this example, two) keyhole slots 23*f* and 23*g* that allow passage of cover fixing screws 29*a* and 29*b* are similarly disposed on a cover main body 23*a* of a second partial cover 23.

Figure 12:
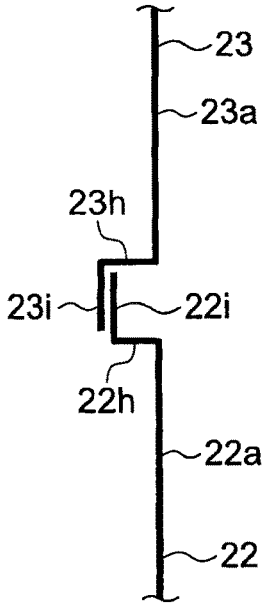
FIG. 12 is a cross section of the first and second partial covers that is taken along Line XII-XII in FIG. 8.

FIG. 12 is a cross section of the first and second partial covers 22 and 23 that is taken along Line XII-XII in FIG. 8. Disposed on an upper end portion of the first partial cover 22 are: a bent portion 22*h* that is formed by bending the cover main body 22*a* perpendicularly toward the case 25; and an overlapping portion 22*i* that is formed by bending an end portion of the bent portion 22*h* perpendicularly upward. In other words, bending that has a Z-shaped cross section is applied to the upper end portion of the cover main body 22*a*.

Disposed on a lower end portion of the second partial cover 23 are: a bent portion 23*h* that is formed by bending the cover main body 23*a* perpendicularly toward the case 25; and an overlapping portion 23*i* that is formed by bending an end portion of the bent portion 23*h* perpendicularly downward. In other words, bending that has a Z-shaped cross section is applied to the lower end portion of the cover main body 23*a*.

When the first and second segmented covers 22 and 23 are in a fully closed position, the overlapping portion. 22*i* and 23*i* are disposed so as to overlap front-to-back when the elevator controlling panel 12 is viewed from the front surface. The overlapping portion 23*i* is disposed behind the overlapping portion 22*i*. Penetration of water into the elevator controlling panel 12 is prevented thereby.

Figure 13:
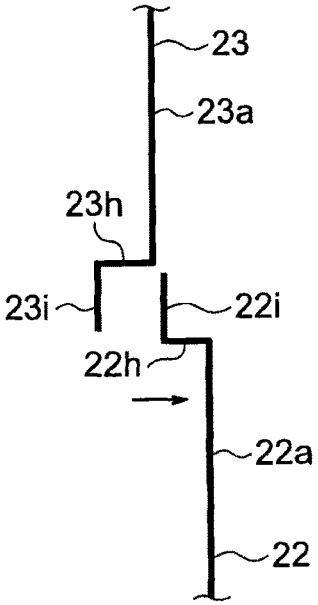
FIG. 13 is a cross section that shows a state in which the first partial cover from FIG. 12 is moved forward.

To open the first partial cover 22 while the second cover segment 23 is fixed to the case 25, the cover fixing screws 27*a* and 27*b* are loosened sufficiently to allow the first partial cover 22 to be moved forward to a position at which the overlapping portion 22*i* does not interfere with the second partial cover 23, as shown in FIG. 13.

Figure 14:
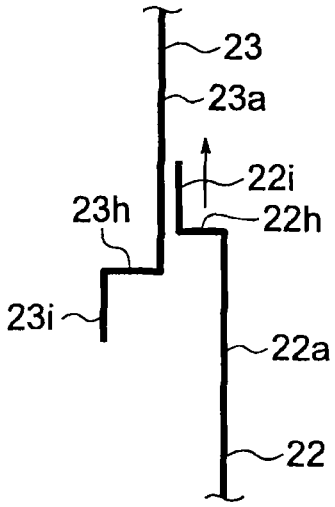
FIG. 14 is a cross section that shows a state in which the first partial cover from FIG. 13 is moved straight upward.

Next, as shown in FIG. 14, the first partial cover 22 is moved straight upward until the cover fixing screws 27*a* and 27*b* enter large diameter portions of the keyhole slots 22*f* and 22*g*. The first partial cover 22 is then moved forward again to remove the cover fixing screws 27*a* and 27*b* from the keyhole slots 22*f* and 22*g*.

Figure 15:
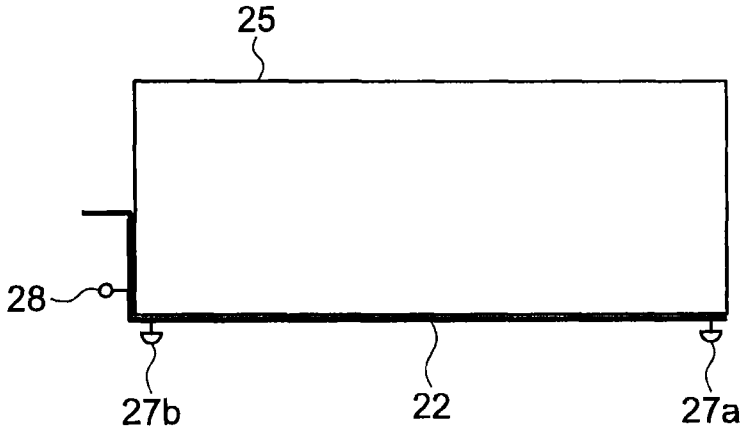
FIG. 15 is a plan that shows a state in which cover fixing screws from FIG. 8 are loosened.
Figure 16:
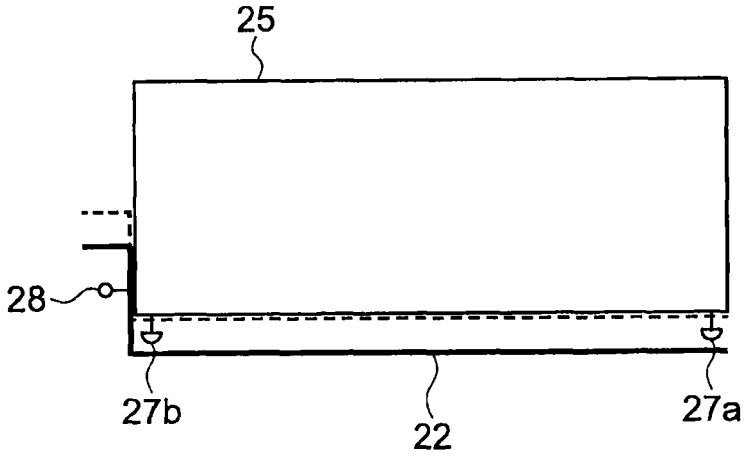
FIG. 16 is a plan that shows a state in which the first partial cover from FIG. 15 is moved forward such that the cover fixing screws are removed from keyhole slots.
Figure 17:
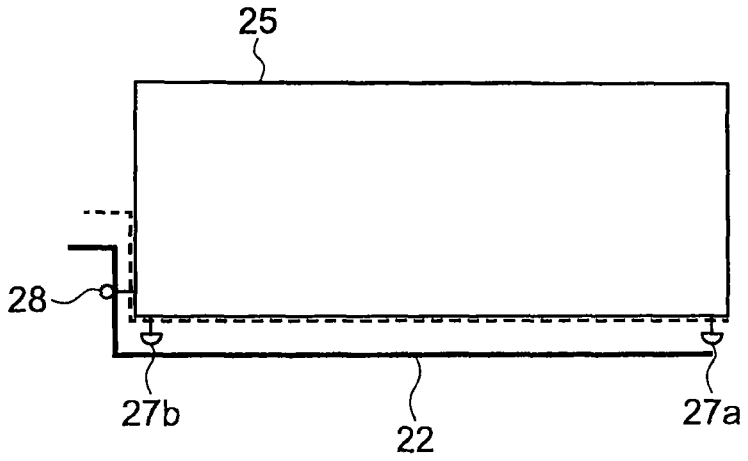
FIG. 17 is a plan that shows a state in which the first partial cover from FIG. 16 is slid to the left in a width direction.

FIG. 15 is a plan that shows a state in which the cover fixing screws 27*a* and 27*b* from FIG. 8 are loosened, and FIG. 16 is a plan that shows a state in which the first partial cover 22 from FIG. 15 is moved forward such that the cover fixing screws 27*a* and 27*b* are removed from the keyhole slots 22*f* and 22*g*. Subsequent operation is similar to that of Embodiment 1, the first partial cover 22 being slid to the left in a width direction of the case 25, as shown in FIG. 17.

Figure 18:
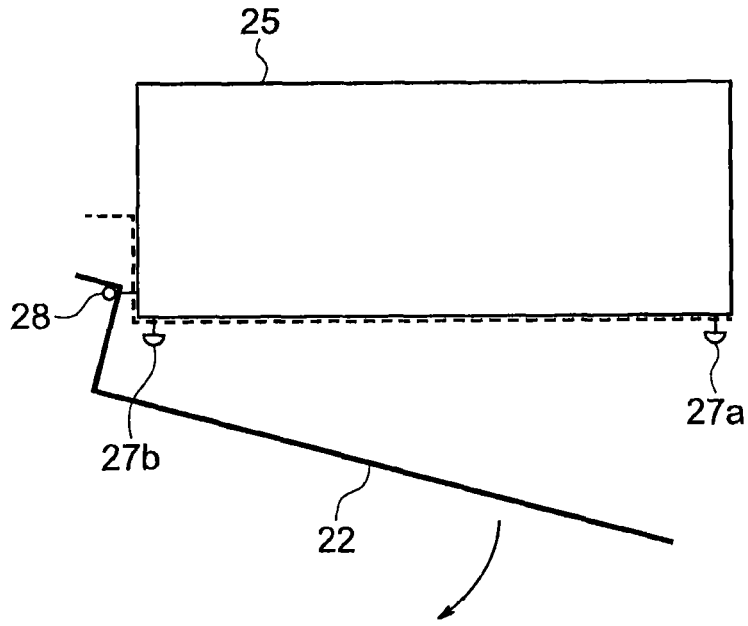
FIG. 18 is a plan that shows an intermediate state during opening out after the first partial cover from FIG. 17 is moved straight upward.

In this state, the first partial cover 22 is slid straight upward until the first shaft member 28 moves to a lower end portion of a vertical portion 32. Next, as shown in FIG. 18, the first partial cover 22 is opened out by approximately 90 degrees around the first shaft member 28. The first partial cover 22 is then moved slightly downward such that the first shaft member 28 moves to an upper end of the opening holding portion 34. When restoring the first partial cover 22 to the fully closed position, the above-mentioned procedure is reversed.

Figure 19:
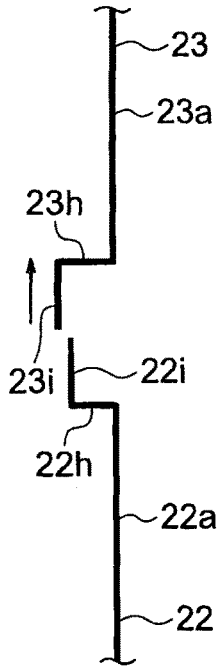
FIG. 19 is a cross section that shows a state in which the second partial cover from FIG. 12 is moved straight upward.

Similarly, to open the second partial cover 22 when the first cover segment 22 is fixed to the case 25, the cover fixing screws 29*a* and 29*b* are loosened to allow the second partial cover 22 to be moved directly upward to a position at which the overlapping portion 23*i* does not interfere with the overlapping portion 22*i*, as shown in FIG. 19. The cover fixing screws 29*a* and 29*b* thereby enter the large diameter portions of the keyhole slots 23*f* and 23*g*. In other words, the overlapping dimensions of the overlapping portions 22*i* and 23*i* are set to dimensions such that the cover fixing screws 29*a* and 29*b* move through the keyhole slots 23*f* and 23*g* from the small diameter portions to the large diameter portions when the overlap is cleared.

Figure 20:
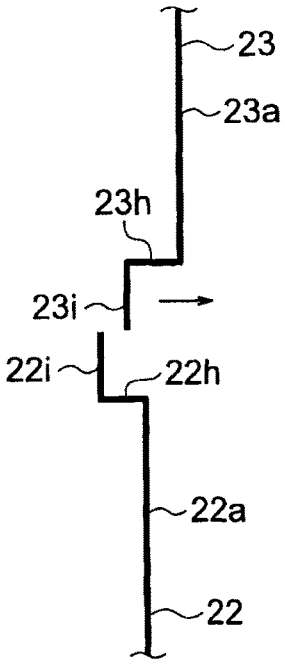
FIG. 20 is a cross section that shows a state in which the second partial cover from FIG. 19 is moved forward.

Next, as shown in FIG. 20, the second partial cover 23 is moved forward to remove the cover fixing screws 29*a* and 29*b* from the keyhole slots 23*f* and 23*g*. The subsequent operation is similar or identical to the opening operation of the first partial cover 22. When restoring the second partial cover 23 to the fully closed position, the above-mentioned procedure is reversed.

Figure 21:
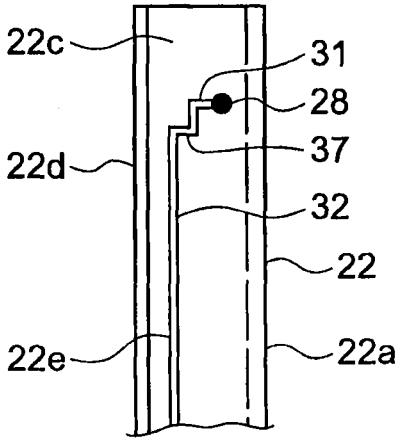
FIG. 21 is a side elevation that shows an upper end portion of the first partial cover from FIG. 9 enlarged.

FIG. 21 is a side elevation that shows an upper end portion of the first partial cover 22 from FIG. 9 enlarged. An L-shaped screw removing portion 37 for removing the cover fixing screws 27*a* and 27*b* from the keyhole slots 22*f* and 22*g* is disposed on the slit 22*e* in Embodiment 2 between an upper portion horizontal portion 31 and the vertical portion 32.

Figure 22:
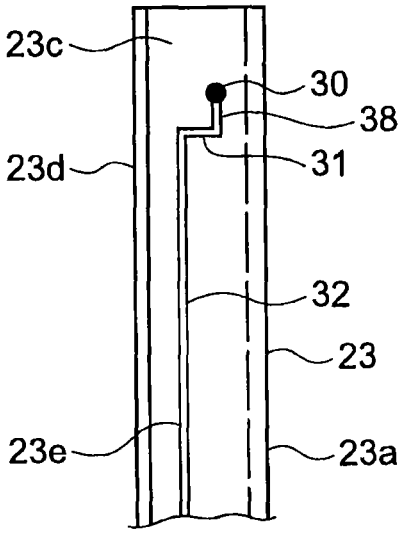
FIG. 22 is a side elevation that shows an upper end portion of the second partial cover from FIG. 9 enlarged.

FIG. 22 is a side elevation that shows an upper end portion of the second partial cover 23 from FIG. 9 enlarged. In the slit 23*e* according to Embodiment 2, an interference clearing portion 38 for clearing interference of the overlapping portion 23*i* with the overlapping portion 22*i* is disposed vertically upward from an end portion of the upper portion horizontal portion 31 near the cover main body 23*a*. When the second partial cover 23 is in the fully closed position, the second shaft member 30 is positioned at the upper end portion of the interference clearing portion 38. The rest of the configuration and operation are similar or identical to those of Embodiment 1.

Thus, according to the elevator controlling panel 12 according to Embodiment 2, the opening portion of the case 25 can be opened while the first and second partial covers 22 and 23 remain connected to the controlling panel main body 21 while avoiding interference between the first and second partial covers 22 and 23 and the car 6 and the safety fence 11, as shown in FIG. 10, enabling similar effects to those in Embodiment 1 to be achieved.

Because the keyhole slots 22*f* and 22*g* are disposed on the first partial cover 22, and the keyhole slots 23*f* and 23*g* are disposed on the second partial cover 23, the first and second segmented covers 22 and 23 can be opened without removing the cover fixing screws 27*a*, 27*b*, 29*a*, and 29*b* from the case 25, enabling dropping and loss of the cover fixing screws 27*a*, 27*b*, 29*a*, and 29*b* to be prevented.

Figure 23:
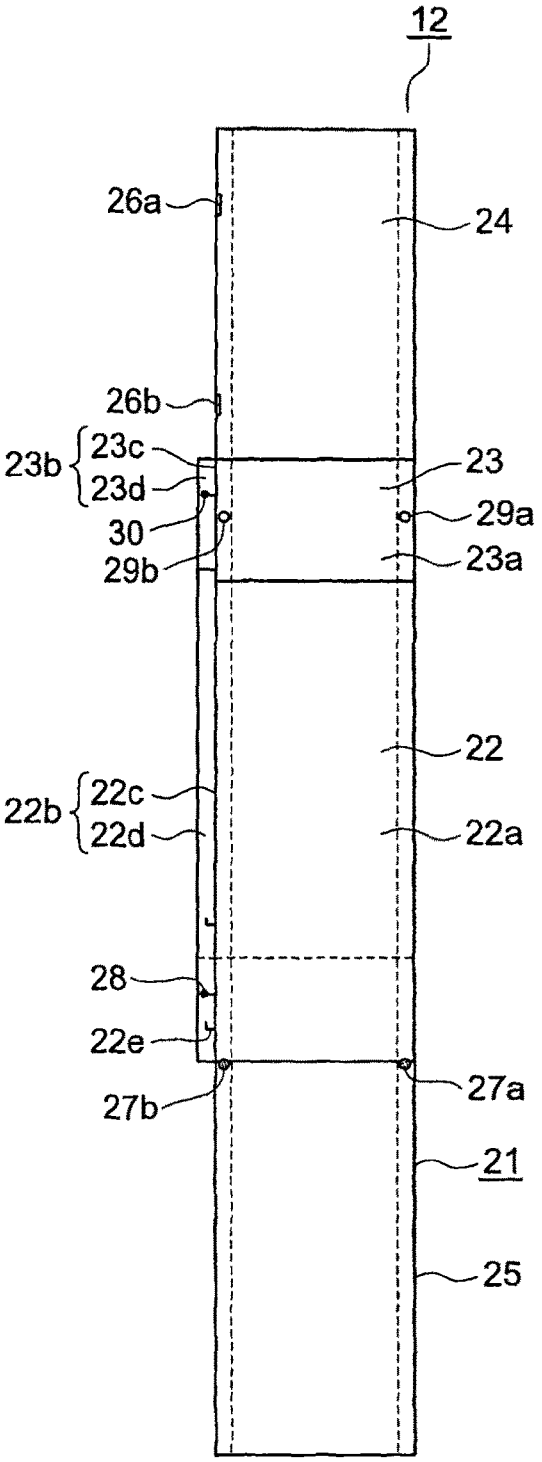
FIG. 23 is a front elevation that shows a state in which a lower end of the first partial cover from FIG. 8 is hooked onto the cover fixing screw.
Figure 24:
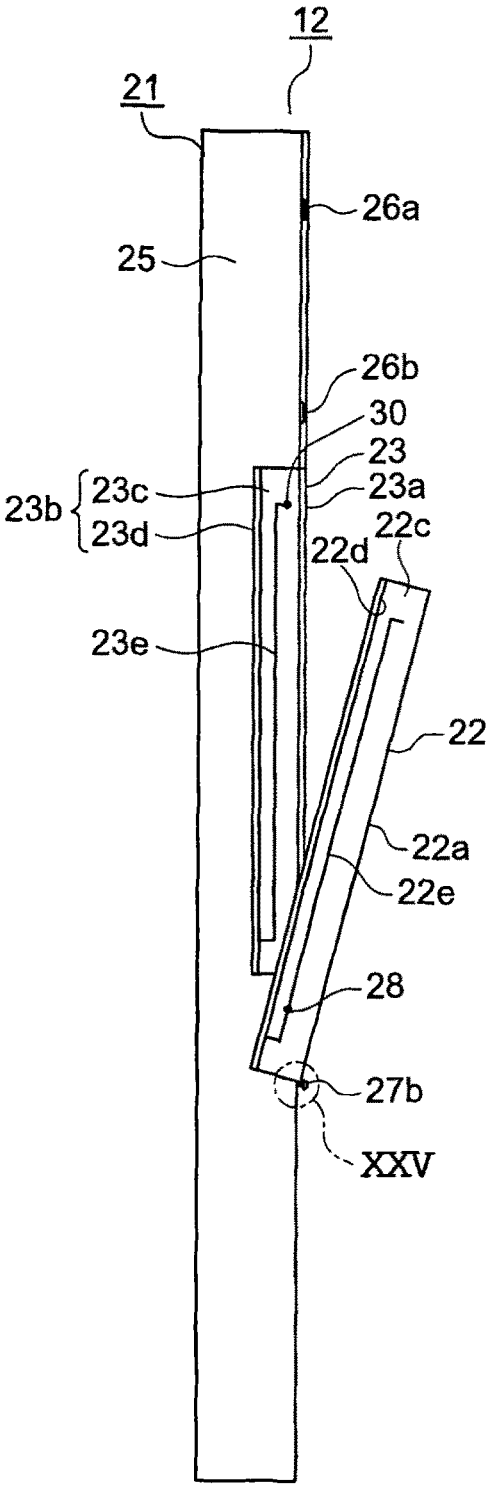
FIG. 24 is a left side elevation that shows an elevator controlling panel from FIG. 23.
Figure 25:
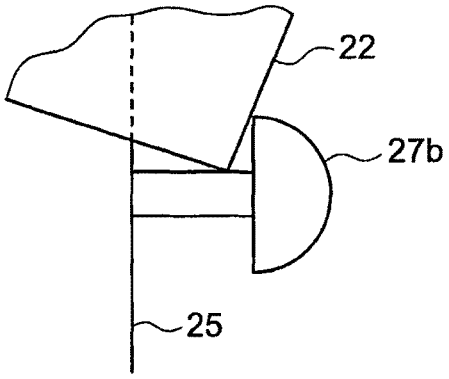
FIG. 25 is a side elevation that shows Portion XXV in FIG. 24 enlarged.

In addition, because the first and second segmented covers 22 and 23 can be opened while the cover fixing screws 27*a*, 27*b*, 29*a*, and 29*b* remain mounted to the case 25, if only the first partial cover 22 is opened, for example, the open state of the portion of the opening portion that corresponds to the first partial cover 22 can easily be held by hooking a lower end of the first partial cover 22 that is slid upward onto the cover fixing screws 27*a* and 27*b*, as shown in FIGS. 23 through 25.

Moreover, clearances can also be disposed between the shaft portion 35 of the shaft members 28 and 30 and the widths of the upper portion horizontal portions 31 of the slits 22*e* and 23*e*, and the cover fixing screws 27*a* and 27*b* removed from the keyhole slots 22*f* and 22*g*, or interference between the overlapping portion 22*i* and the overlapping portion 23*i* cleared, using these clearances. The shapes of the slits 22*e* and 23*e*; can thereby be simplified in a similar or identical manner to Embodiment 1.

Embodiment 3

Figure 26:
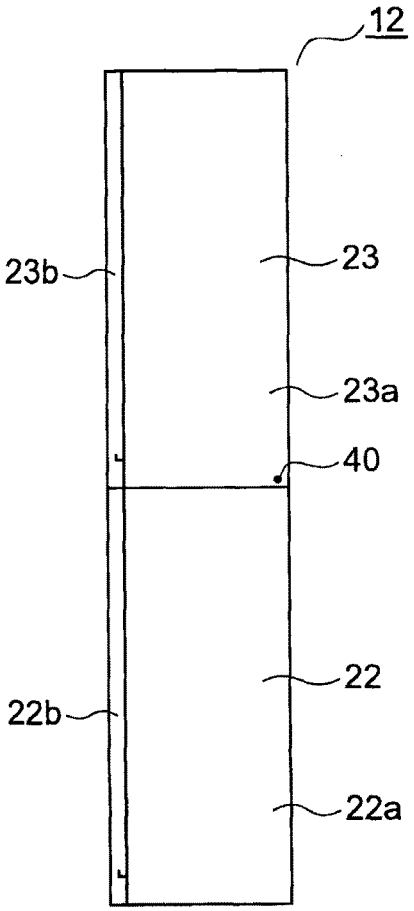
FIG. 26 is a front elevation that shows an elevator controlling panel according to Embodiment 3 of the present invention.
Figure 27:
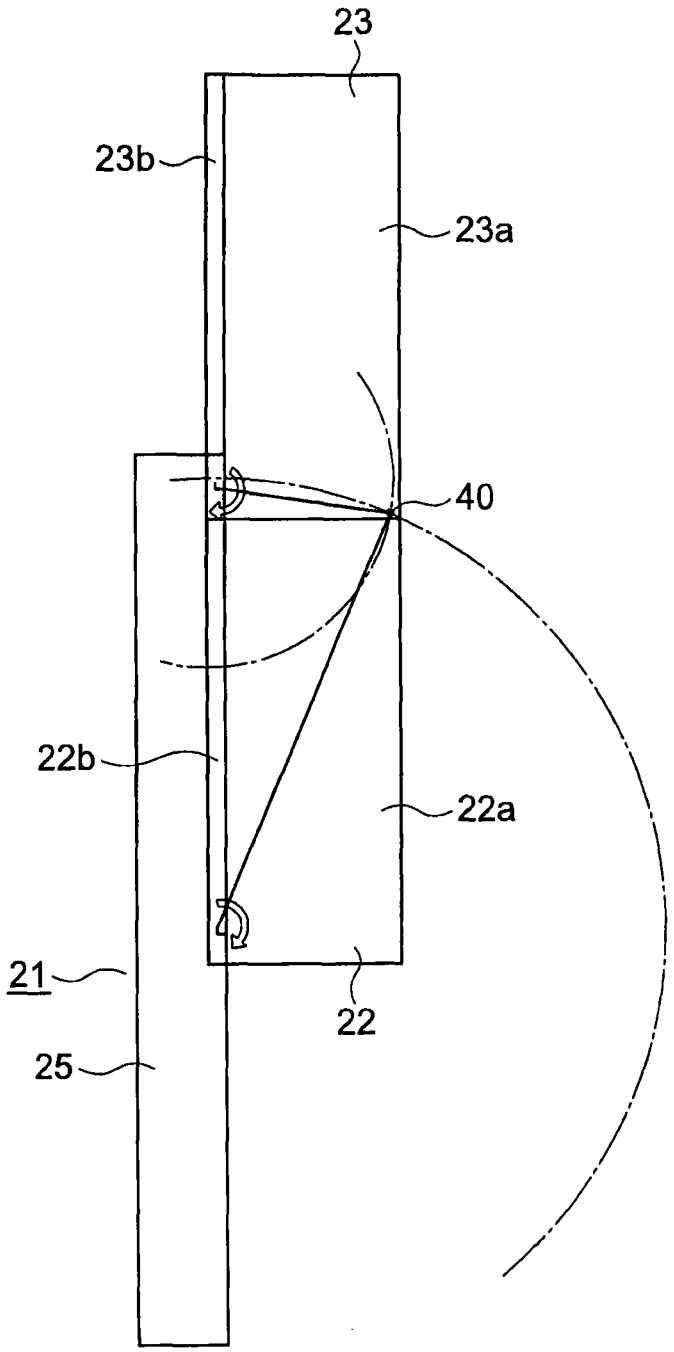
FIG. 27 is a left side elevation that shows a state in which first and second partial covers from FIG. 26 are opened out to a fully open position.

Next, FIG. 26 is a front elevation that shows an elevator controlling panel 12 according to Embodiment 3 of the present invention, and FIG. 27 is a left side elevation that shows a state in which first and second partial covers 22 and 23 from FIG. 26 are opened out to a fully open position.

In Embodiments 1 and 2, a door-type third partial cover 24 was used, but in Embodiment 3, only first and second partial covers 22 and 23 are used. A coupling portion 40 that couples when the first and second partial covers 22 and 23 are in an opened-out state to hold the opened-out state is disposed on the first and second partial covers 22 and 23.

Figure 28:
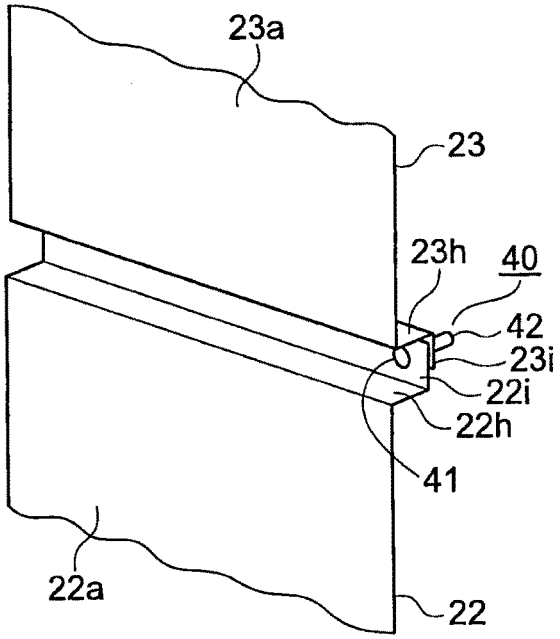
FIG. 28 is an oblique projection that shows part of FIG. 26.

FIG. 28 is an oblique projection that shows part of FIG. 26. The coupling portion 40 has: a coupling aperture 41 that is disposed on an overlapping portion 22*i* of a first partial cover 22; and a coupling pin 42 that is disposed on an overlapping portion 23*i* of a second partial cover 23. The coupling pin 42 protrudes away from the coupling aperture 41, and is not inserted into the coupling aperture 41, when the first and second partial covers 22 and 23 are in a fully closed position.

Figure 29:
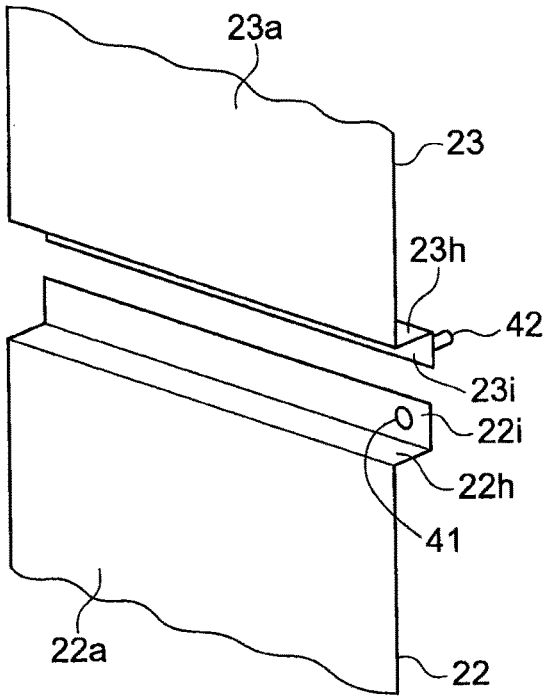
FIG. 29 is an oblique projection that shows a state in which the second partial cover from FIG. 28 is moved straight upward.
Figure 30:
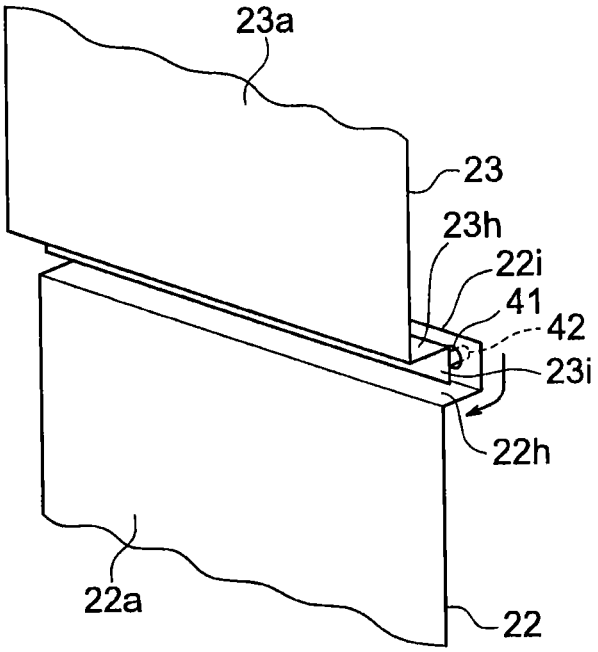
FIG. 30 is an oblique projection that shows the state in which a coupling pin is inserted into a coupling aperture from FIG. 28.

FIG. 29 is an oblique projection that shows a state in which the second partial cover 23 from FIG. 28 is moved straight upward, and FIG. 30 is an oblique projection that shows the state in which the coupling pin 42 is inserted into the coupling aperture 41 from FIG. 28. In Embodiment 3, in contrast to when in the fully closed position, the order of the overlapping portions 22*i* and 23*i* from front to back is reversed, and the coupling pin 42 is inserted into the coupling aperture 41, when the first and second partial covers 22 and 23 are in a fully open position. The first and second partial covers 22 and 23 are thereby held in the opened-out state. The rest of the configuration is similar or identical to Embodiments 1 or 2.

According to a configuration of this kind, the movable range of the first and second partial covers 22 and 23 is constrained by the coupling portion 40, enabling the first and second partial covers 22 and 23 to be held in the opened-out state without using another holding means (mechanism).

Embodiment 4

Figure 31:
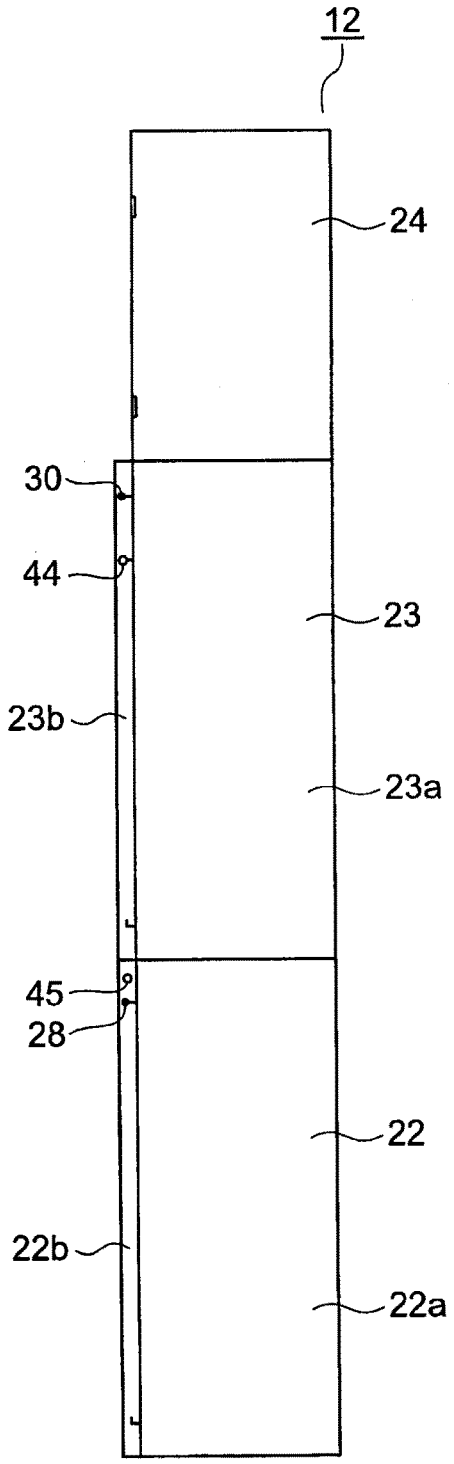
FIG. 31 is a front elevation that shows an elevator controlling panel according to Embodiment 4 of the present invention.
Figure 32:
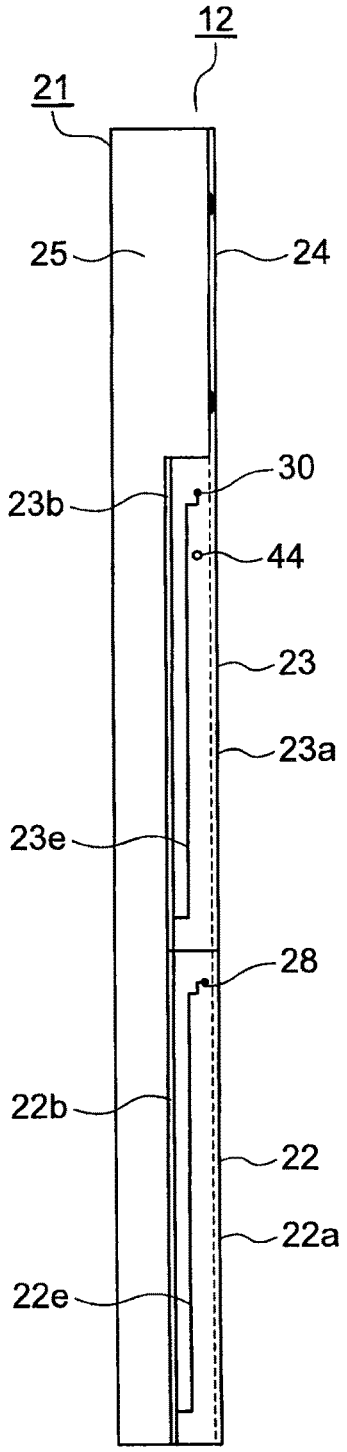
FIG. 32 is a left side elevation that shows the elevator controlling panel from FIG. 31.
Figure 33:
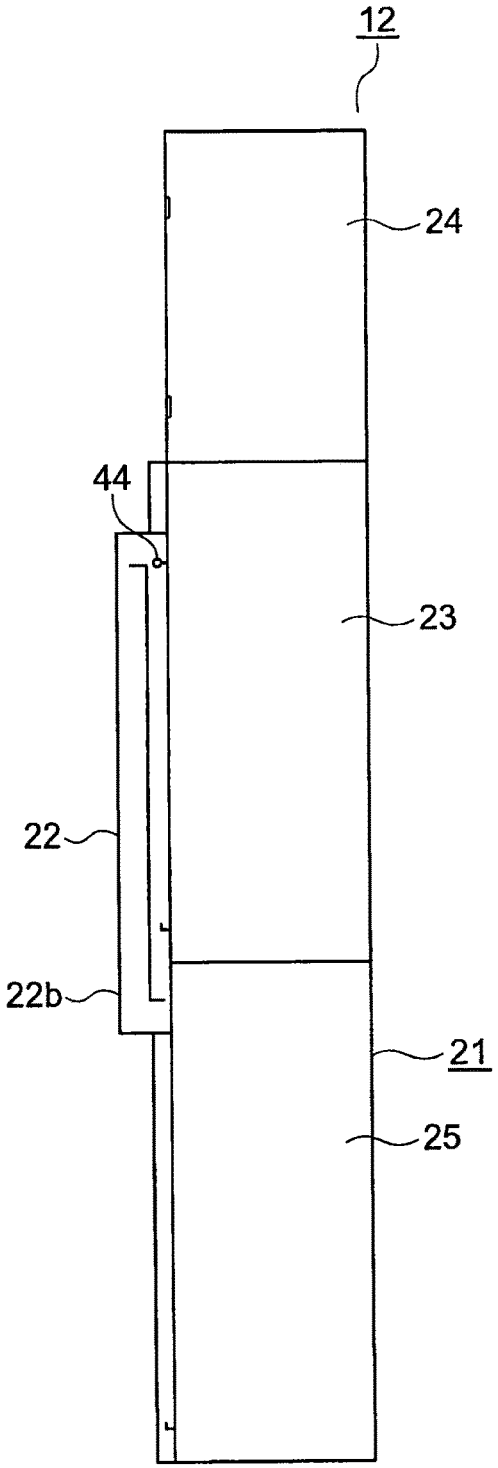
FIG. 33 is a front elevation that shows the state in which a first partial cover from FIG. 31 is opened out to a fully open position.
Figure 34:
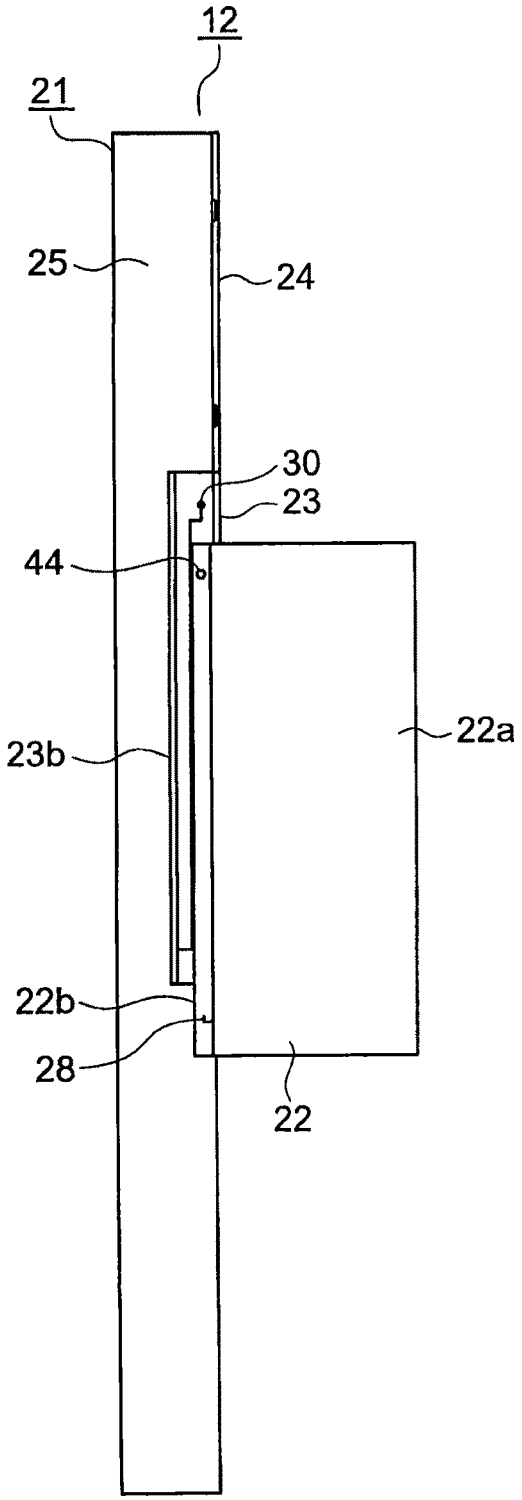
FIG. 34 is a left side elevation that shows the elevator controlling panel from FIG. 33.

Next, FIG. 31 is a front elevation that shows an elevator controlling panel 12 according to Embodiment 4 of the present invention, FIG. 32 is a left side elevation that shows the elevator controlling panel 12 from FIG. 31, FIG. 33 is a front elevation that shows the state in which a first partial cover 22 from FIG. 31 is opened out to a fully open position, and FIG. 34 is a left side elevation that shows the elevator controlling panel 12 from FIG. 33.

A hook 44 is disposed on a bent portion 23*b* (a cover side surface portion 23*c*) of a second partial cover 23. A hook aperture 45 through which the hook 44 is passed when the first partial cover 22 is in a fully open position is disposed on a bent portion 22*b* (a protruding portion 22*d*) of the first partial cover 22. An opened-out state of the first partial cover 22 is held by using the hook aperture 45 to engage the hook 44 when the first partial cover 22 is in the opened-out state.

Figure 35:
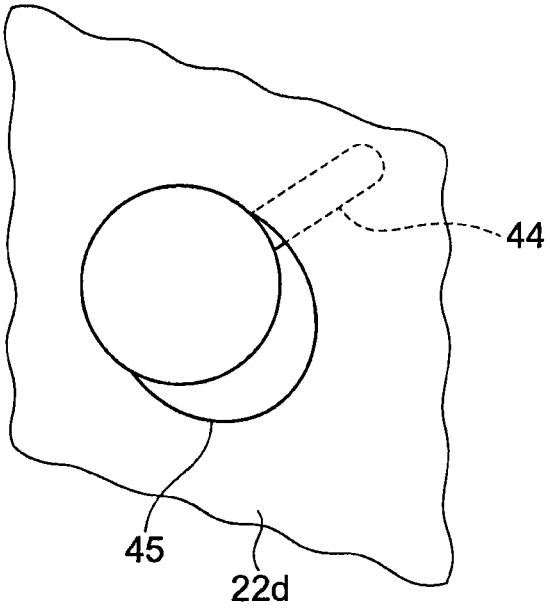
FIG. 35 is an oblique projection that shows a hook from FIG. 34 enlarged.
Figure 36:
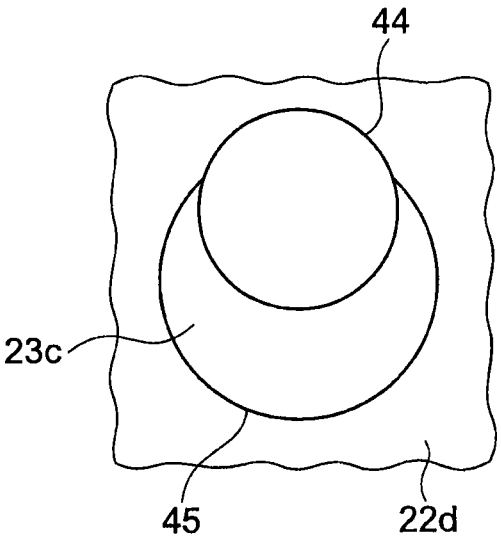
FIG. 36 is a front elevation that shows the hook from FIG. 35.
Figure 37:
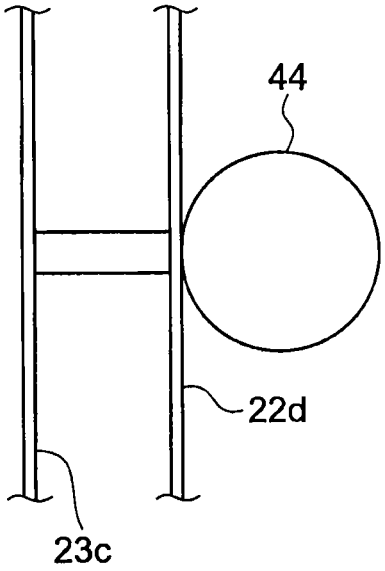
FIG. 37 is a left side elevation that shows the hook from FIG. 36.

FIG. 35 is an oblique projection that shows the hook 44 from FIG. 34 enlarged, FIG. 36 is a front elevation that shows the hook 44 from FIG. 35, and FIG. 37 is a left side elevation that shows the hook 44 from FIG. 36. The hook 44 has spherical latch that is disposed on a tip end of a pin. However, the shape of the hook 44 is not limited thereto, and may alternatively be a simple L-shaped fitting, etc. Of course, the hook 44 does not interfere with the first partial cover 22 when the first partial cover 22 is moved to the fully open position. The rest of the configuration and operation are similar or identical to those of any one of Embodiments 1 through 3.

According to a configuration of this kind, the opened-out state of the first partial cover 22 can be held more reliably by a simple configuration. Because the hook aperture 45 is positioned on a protruding portion 22*d* that protrudes outward from a side surface of the elevator controlling panel 12 when the first partial cover 22 is in a closed state, it does not cause functional problems or restrictiveness.

Moreover, in Embodiment 4, the hook 44 is disposed on a second partial cover 23 that is adjacently above the first partial cover 22, but if the front cover is only a single part, the hook may be disposed on the case, or if the front cover that is adjacently above is a door-type cover, the hook may be disposed on the door-type cover.

In Embodiments 1 through 4, the cover fixing screws 27*a* and 27*b* are disposed on the left and right of the cover main body 22*a*, but may alternatively be disposed on only one of either the left or right.

In addition, in Embodiments 1 through 4, the bent portions 22*b* and 23*b* are formed by bending the first end portions of the cover main bodies 22*a* and 23*a* in the width direction, but separate members may alternatively be fixed to the first end portions of the cover main bodies 22*a* and 23*a* in the width direction as bent portions.

Furthermore, the overall layout of the elevator apparatus is not limited to that in FIG. 1, and the elevator controlling panel according to the present invention may alternatively be applied to elevator apparatuses that have other layouts.

The invention claimed is:

1. An elevator controlling panel comprising:

a controlling panel main body that has a case having a front surface extending in a vertical plane and defining an opening portion; and a front cover that opens and closes the opening portion, wherein:

a bent portion is disposed on a first end portion in a width direction in a plane of the vertically extending front cover;

a slit is disposed on the bent portion;

a shaft member that guides opening and closing operations of the front cover by being moved relatively along the slit, and that also stops the front cover from dislodging from the case, is disposed on a side surface of the case; and the slit has a shape such that the opening portion is opened by sliding the front cover forward relative to the controlling panel main body, in a forward direction away from the controlling panel main body and perpendicular to the plane of the vertically extending front cover, and then upward in an upward direction in the plane of the vertically extending front cover and perpendicular to the width direction.

2. The elevator controlling panel according to claim 1, wherein the slit has a shape that enables opening of the opening portion by sliding the front cover upward and then rotating the front cover around the shaft member.

3. The elevator controlling panel according to claim 2, wherein the bent portion is formed by bending the first end portion in the width direction of the front cover into a Z-shaped cross section.

4. The elevator controlling panel according to claim 1, wherein:

the shaft member includes:

a shaft portion that is passed through the slit; and a head portion that is disposed on an end portion of the shaft portion, and that stops dislodging of the shaft member from the slit; and a clearance is disposed between the head portion and the front cover, the front cover being slidable in the width direction of the case by an amount equal to the clearance.

5. The elevator controlling panel according to claim 1, wherein:

the front cover is fixed to the case by a cover fixing screw when in a fully closed position; and a keyhole slot that allows passage of the cover fixing screw is disposed on the front cover.

6. The elevator controlling panel according to claim 5, wherein a state in which the opening portion is opened is held by hooking onto the cover fixing screw an end of the front cover that is slid upward in the upward direction.

7. The elevator controlling panel according to claim 1, wherein:

the front cover includes:

a first partial cover; and a second partial cover that is disposed adjacently above the first partial cover in the upward direction;

the bent portion and the slit are disposed on each of the first and second partial covers; and the shaft member includes:

a first shaft member that corresponds to the first partial cover; and a second shaft member that corresponds to the second partial cover.

8. The elevator controlling panel according to claim 7, wherein:

the slits of the first and second partial covers have shapes that enable opening of the opening portion by sliding the first and second partial covers upward in the upward direction and then rotating the first and second partial covers around the first and second shaft members; and coupling portions that hold an opened state of the opening portion by coupling with the first and second partial covers in the opened state are disposed on the first and second partial covers.

9. The elevator controlling panel according to claim 7, wherein:

the slit of the first partial cover has a shape that enables opening of the opening portion by sliding the first partial cover upward in the upward direction and then rotating the first partial cover around the first shaft member;

a hook is disposed on the bent portion of the second partial cover; and an opened-out state of the first partial cover is held by hooking the first partial cover onto the hook in the opened-out state.

10. An elevator apparatus comprising:

a car that is raised and lowered in a vertical direction inside a hoistway; and an elevator controlling panel that is disposed inside the hoistway, and on which maintenance work is performed from on vertically topmost top of the car, the elevator controlling panel comprising:

a controlling panel main body that has a case having a front surface extending in a vertical plane and defining an opening portion; and a front cover that opens and closes the opening portion, wherein:

a bent portion is disposed on a first end portion in a width direction in a plane of the vertically extending front cover;

a slit is disposed on the bent portion;

a shaft member that guides opening and closing operations of the front cover by being moved relatively along the slit, and that also stops the front cover from dislodging from the case, is disposed on a side surface of the case; and the slit has a shape such that the opening portion is opened by sliding the front cover forward relative to the controlling panel main body, in a forward direction away from the controlling panel main body and perpendicular to the plane of the vertically extending front cover, and then upward in an upward direction in the plane of the vertically extending front cover and perpendicular to the width direction.

11. The elevator apparatus according to claim 10, wherein:

a safety fence is disposed on an upper portion of the car in the upward direction; and the front cover is slidable until the front cover is higher than an upper end of the safety fence when a floor surface above the car is made level with a lower end of the front cover.

* * * * *